US007859178B2

(12) United States Patent
Yoshida

(10) Patent No.: US 7,859,178 B2
(45) Date of Patent: Dec. 28, 2010

(54) SPARK PLUG FOR INTERNAL COMBUSTION ENGINE AND RELATED MANUFACTURING METHOD

(75) Inventor: Koichi Yoshida, Aichi-ken (JP)

(73) Assignee: Denso Corporation, Kariya (JP)

( * ) Notice: Subject to any disclaimer, the term of this patent is extended or adjusted under 35 U.S.C. 154(b) by 951 days.

(21) Appl. No.: 11/717,788

(22) Filed: Mar. 14, 2007

(65) Prior Publication Data

US 2007/0216278 A1 Sep. 20, 2007

(30) Foreign Application Priority Data

Mar. 14, 2006 (JP) ..... 2006-069246

(51) Int. Cl.
*H01T 13/20* (2006.01)

(52) U.S. Cl. ..... 313/141; 313/142

(58) Field of Classification Search ..... 313/118–145
See application file for complete search history.

(56) References Cited

U.S. PATENT DOCUMENTS 5,877,584 A 3/1999 Kato et al.
6,707,237 B2 3/2004 Teramura et al.
2003/0028107 A1* 2/2003 Miller et al. ..... 600/437
2006/0028107 A1* 2/2006 Hori et al. ..... 313/141

FOREIGN PATENT DOCUMENTS

JP 10-041047 2/1998
JP 11-087014 3/1999
JP 2001-307858 11/2001

* cited by examiner

*Primary Examiner*—Toan Ton
*Assistant Examiner*—Zachary Snyder
(74) *Attorney, Agent, or Firm*—Nixon & Vanderhye PC

(57) ABSTRACT

A spark plug is disclosed as having a metal shell, a porcelain insulator fixedly secured to the metal shell, a center electrode and a ground electrode providing a spark discharge gap with the center electrode. The porcelain insulator has a through-bore partially exposed from an end face of the ground electrode in a surface area S1, as viewed from a distal end of the spark plug, and having a total surface area S2 falling in the relationship S1/S2≦0.3. The center electrode protrudes from the porcelain insulator with a protruding length L under the relationship L≦0.6 mm. A minimal value Hmin and a maximal value Hmax in distance between the ground electrode and the end face of the porcelain insulator lies in the relationship Hmax/Hmin≦1.3. Wall thickness T between the through-bore and an outer periphery of the porcelain insulator lies in the relationship T≦0.7 mm.

7 Claims, 10 Drawing Sheets

SPARK PLUG FOR INTERNAL COMBUSTION ENGINE AND RELATED MANUFACTURING METHOD

CROSS REFERENCE TO RELATED APPLICATIONS

This application is based on Japanese Patent Application No. 2006-69246, filed on Mar. 14, 2006, the content of which is hereby incorporated by reference.

BACKGROUND OF THE INVENTION

1. Field of the Invention

The present invention relates to spark plugs for internal combustion engines and, more particularly, to a spark plug for an internal combustion engine of a motor vehicle or the like.

2. Description of the Related Art

In the related art, attempts have heretofore been made to provide spark plugs as igniting means for internal combustion engines of motor vehicles or the like.

The spark plug generally includes a center electrode and a ground electrode between which a spark discharge gap is provided. Applying a high voltage across the center electrode and the ground electrode allows a spark discharge to take place in the spark discharge gap, thereby igniting an air-fuel mixture.

With the development of automotive internal combustion engines operating on high fuel consumption at high power output, there's been an increase of research into direct injection (DI) engines. The DI engines are generally categorized by combustion modes in two types including a stratified charge combustion type and a homogeneous and stoichiometric combustion. In any case, issues arise with spark plugs suffering from the occurrence of defacements due to fuel directly injected into combustion chambers. Therefore, in recent years, it has been strongly desired to provide new types of spark plugs having increased defacement resistance.

That is, with the DI engine of the related art discussed above, as fuel is directly injected into the combustion engine to form an air/fuel mixture therein and fuel in the air/fuel mixture is liable to adhere onto a center electrode 16 and a ground electrode 18 as shown in FIG. 6. Then, there is a fear of fuel progressively adhering onto the center electrode 16 and the ground electrode 18 so as to link these electrodes in a fuel bridge 30. As the fuel bridge 30 is created, even if a spark discharge is performed, a misfiring tends to occur due to anti-inflammatory action resulting from the presence of liquid fuel. This results in the occurrence of a fear of deterioration occurring in startability of the internal combustion engine.

To address such issues, Japanese Patent Unexamined Application Publication No. 2001-307858 discloses a spark plug structured to suppress the occurrence of a fuel bridge by forming a center electrode in a narrow diameter or utilizing means such as a protruding portion provided on a ground electrode.

However, even with such measure taken on the spark plug, the spark plug encounters a difficulty of appropriately removing the fuel bridge from the center electrode and the ground electrode under circumstances where a large amount of fuel is present for the fuel bridge to be formed like a situation where the engine remains at, for instance, ultracold temperatures or circumstances where fuel has a high viscosity.

SUMMARY OF THE INVENTION

The present invention has been completed with the above view in mind and has an object to provide a spark plug for an internal combustion engine that has increased fuel-bridging resistance.

To achieve the above object, a first aspect of the present invention provides a spark plug for an internal combustion engine, comprising a metal shell having an outer periphery formed with a mounting thread, a porcelain insulator fixedly secured to the metal shell on a central axis thereof and having a through-bore, a center electrode, having a leading end portion, which extends through the through-bore of the porcelain insulator and retained therewith in a fixed place along the central axis of the porcelain insulator, and a ground electrode extending from the metal shell and having a leading end placed in face-to-face relationship with the leading end portion of the center electrode to provide a spark discharge gap. The through-bore of the porcelain insulator is exposed from an end face of the leading end portion of the ground electrode in a surface area S1, as viewed from a distal end of the spark plug, and has a total surface area S2 falling in the relationship expressed as $S1/S2 \leqq 0.3$. The center electrode protrudes from an end face of the porcelain insulator with a protruding length L under the relationship expressed as $L \leqq 0.6$ mm. A minimal value Hmin and a maximal value Hmax in distance between a planar surface section of the ground electrode and the end face of the porcelain insulator lay in the relationship expressed as $Hmax/Hmin \leqq 1.3$. A wall thickness T between the through-bore and an outer periphery of the porcelain insulator lies in the relationship expressed as $T \leqq 0.7$ mm and the leading end of the center electrode has a diameter d under the relationship expressed as $d \leqq 0.6$ mm.

With the structure of the present embodiment, the spark plug implementing the present invention has advantages effects described below.

The component parts of the spark plug are specified under the dimensional relationships described above. With such dimensional relationships, during a phase in which a fuel bridge is formed between the center electrode and the ground electrode, liquid fuel adheres onto an entire circumference of the distal end of the porcelain insulator so as to cover the center electrode and the through-bore of the porcelain insulator.

Under such a status, if a high voltage is applied across the center electrode and the ground electrode, spark discharge occurs through a spark discharge path penetrating through an inside of liquid fuel. That is, if the fuel bridge is not formed in a pattern so as to cover the center electrode the through-bore of the porcelain insulator, the spark discharge path takes the form of a path passing through an air/fuel mixture with less insulating resistance or a surface of liquid fuel. However, with the spark plug of the present invention, as set forth above, liquid fuel adheres onto the entire circumference of the distal end of the porcelain insulator in a way to cover the center electrode and the through-bore of the porcelain insulator during the formation of the fuel bridge. This blocks the formation of a spark discharge path passing through the area with less insulating resistance as previously noted above, permitting the spark discharge path to be formed in a way to pass through an inside of liquid fuel bridged between the center electrode and the ground electrode.

Then, due to energy of spark discharge passing through liquid fuel bridged between the center electrode and the ground electrode, the fuel bridge is broken down and removed from the center electrode and the ground electrode. That is, causing the spark discharge to occur in the inside of liquid fuel forming the fuel bridge enables discharge energy to instantaneously evaporate a partial area of the inside of liquid fuel. This allows the fuel bridge to be broken down from the inside thereof to the outside, making it possible to instantaneously remove the fuel bridge from the electrodes.

The advantageous effects, resulting from the dimensional relationships, are described below in detail.

First, the surface area S1, exposed from the end face of the leading end portion of the ground electrode, of the through-bore of the porcelain insulator as viewed from the distal end of the spark plug, and the total surface area S2 of the through-bore of the porcelain insulator lies under the relationship expressed as S1/S2≦0.3. This enables the fuel bridge to be easily formed in a pattern so as to cover the entire circumference of the through-bore of the porcelain insulator in an air space between the end face of the leading end portion of the porcelain insulator and the planar surface section of the leading end portion of the ground electrode.

Further, with the noble metal tip protruding from the end face of the leading end portion of the porcelain insulator in the protruding length L under the relationship expressed as L≦0.6 mm, the fuel bridge becomes liable to easily adhere onto not only an area between the end face of the leading end portion of the porcelain insulator and the planar surface section of the leading end portion of the ground electrode but also the leading end portion of the porcelain insulator.

Further, with the spark plug of the structured mentioned above, the maximum value Hmax and the minimum value Hmin in distance between the planar surface section of the ground electrode and the end face of the leading end portion of the porcelain insulator lie in the relationship expressed as Hmax/Hmin≦1.3. Such a positional relationship prevents the fuel bridge from being formed in a deviated position dislocated from a correct position, enabling the fuel bridge to be easily formed in an appropriate pattern so as to cover the entire circumference of the through-bore of the porcelain insulator.

Further, since the wall thickness T of the leading end portion of the porcelain insulator lies in the relationship expressed as T≦0.7 mm, the fuel bridge is prevented from having an excessively increased contact surface area for the leading end portion of the porcelain insulator. This enables the prevention of the fuel bridge from being formed in a disproportionate pattern. Accordingly, the fuel bridge can be formed in an appropriate pattern so as to cover the entire circumference of the through-bore of the porcelain insulator.

Furthermore, with the leading end of the center electrode having the diameter "d" laying under the relationship expressed as d≦0.6 mm, the fuel bridge is liable to adhere onto not only an area between the center electrode and the ground electrode but also the end face of the leading end portion of the porcelain insulator. This enables the fuel bridge to be formed in an appropriate pattern so as to cover the entire circumference of the through-bore of the porcelain insulator.

Thus, with the spark plug comprising the component parts arranged under the dimensional relationships set forth above, the spark plug causes the fuel bridge to be easily formed in an appropriate pattern so as to cover the entire circumference of the through-bore of the porcelain insulator. This allows a σπαρκ discharge to easily occur in the inside of the fuel bridge, thereby enabling spark discharge energy to instantaneously remove the fuel bridge.

Therefore, it becomes possible to obtain a spark plug for an internal combustion engine with increased fuel-bridging resistance.

Further, in a case where the surface area S1 and the surface area S2 have the relationship S1/S2>0.3, there is a fear of a difficulty occurring in forming the fuel bridge in the air space between the leading end portion of the porcelain insulator and the ground electrode in a pattern so as to cover the entire circumference of the through-bore of the porcelain insulator. In addition, it is preferable for the relationship to be established as S1=0. That is, the center electrode and the ground electrode may be preferably positioned with respect to each other not to expose the through-bore of the porcelain insulator from the end face of the ground electrode.

Moreover, if the center electrode protrudes from the end face of the porcelain insulator in an increased protruding length L under the relationship L>0.6 mm, the fuel bridge becomes liable to adhere onto only the area between the center electrode and the ground electrode. Thus, there is a fear of a difficulty encountered for the fuel bridge to be formed so as to cover the entire circumference of the through-bore of the porcelain insulator.

If the distance H takes an increased value between the minimal value Hmin and the maximal value Hmax in the relationship expressed as Hmax/Hmin>1.3, the fuel bridge tends to be formed in a deviated area under a disproportionate pattern. This results in difficulty for the fuel bridge to be formed so as to cover the entire circumference of the through-bore of the porcelain insulator.

Further, if the wall thickness T of the porcelain insulator takes an increased value under the relationship expressed as T>0.7 mm, the fuel bridge has a contact surface that is too large for the end face of the porcelain insulator, the fuel bridge has a fear to be formed in the deviated position away from a correct position. Thus, there is a fear of the fuel bridge encountering a difficulty of covering the entire circumference of the through-bore of the porcelain insulator.

With the spark plug for the internal combustion engine of the present embodiment, the spark discharge gap may have a size G falling in the relationship expressed as G≦1.3 mm.

With such a structure, the fuel bridge is formed in a stable position, providing an ease of forming the furl bridge in a way to cover the entire circumference of the through-bore of the porcelain insulator.

With the structure remaining under the relationship of G>1.3 mm, the fuel bridge is liable to be formed in an instable position with the resultant difficulty of covering the entire circumference of the through-bore of the porcelain insulator.

With the spark plug for the internal combustion engine of the present embodiment, the through-bore of the porcelain insulator may have an inner diameter D under the relationship expressed as D≦2.5 mm.

With the structure remaining under the relationship of D>2.5 mm, the amount of fuel needed for covering the entire circumference of the through-bore of the porcelain insulator increases in excess, causing a difficulty to occur in covering the entire circumference of the through-bore of the porcelain insulator.

With the spark plug for the internal combustion engine of the present embodiment, the leading end portion of the center electrode may preferably comprise a noble metal chip.

The presence of the noble metal chip carried on the center electrode allows the spark plug to have increased wear-resistance and provide an ease of forming a spark discharge path in the inside of the fuel bridge formed between the center electrode and the ground electrode.

With the spark plug for the internal combustion engine of the present embodiment, the planar surface section of the ground electrode may preferably comprise a noble metal chip placed in face-to-face relationship with the noble metal chip of the center electrode to provide the spark discharge gap.

With the spark plug of the present embodiment, the ground electrode can have increased wear-resistance and fire-jumping ability.

With the spark plug for the internal combustion engine of the present embodiment, the noble metal chip of the ground electrode may be preferably placed on the planar surface section in a coplanar relationship therewith and in face-to-face relationship with the noble metal chip of the center electrode to provide the spark discharge gap.

With the spark plug of the present embodiment, the ground electrode can have increased wear-resistance and fire-jumping ability.

With the spark plug for the internal combustion engine of the present embodiment, the noble metal chip of the ground electrode may preferably protrude from the planar surface section in face-to-face relationship with the noble metal chip of the center electrode to provide the spark discharge gap.

With the spark plug of the present embodiment, the ground electrode can have increased wear-resistance and fire-jumping ability.

DETAILED DESCRIPTION OF THE PREFERRED EMBODIMENTS

Figure 1:
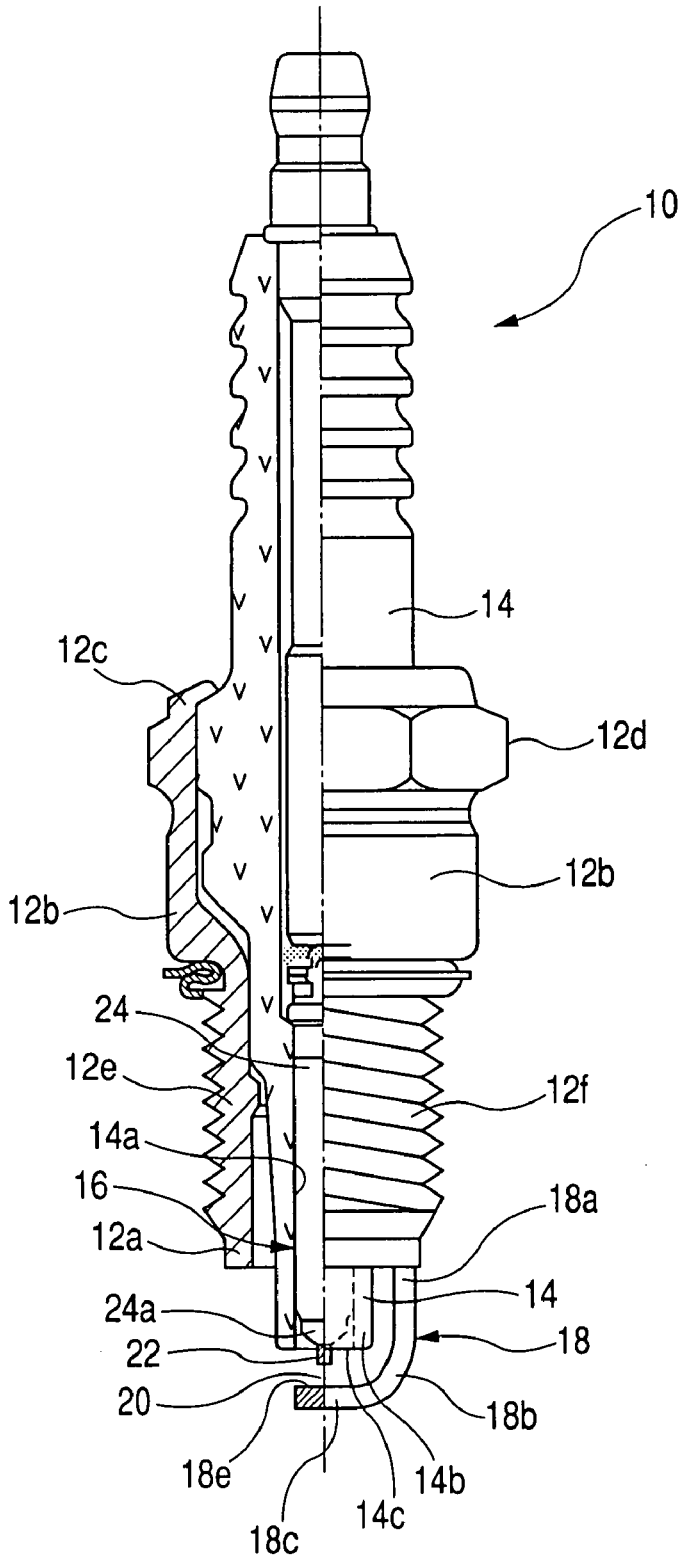
FIG. 1 is a half cross-sectional view showing an overall structure of a spark plug of a first embodiment according to the present invention.

Now, spark plugs for an internal combustion engine of various embodiments according to the present invention are described below in detail with reference to the accompanying drawings. However, the present invention is construed not to be limited to such embodiments described below and technical concepts of the present invention may be implemented in combination with other known technologies or the other technology having functions equivalent to such known technologies.

In the following description, like reference characters designate like or corresponding parts throughout the several views. Also in the following description, description on the same component parts of one embodiment as those of another embodiment is omitted, but it will be appreciated that like reference numerals designate the same component parts throughout the drawings.

The spark plugs for the internal combustion engine of the various embodiments according to the present invention may be used as igniting means of an automotive internal combustion engine.

Further, in the following description, a portion, inserted to a combustion chamber of an internal combustion engine, of the spark plug will be referred to "a distal end" and the opposite side will be referred to as "a base end".

First Embodiment

A spark plug of a first embodiment according to the present invention is described below in detail with reference to FIG. 1 to 9 of the accompanying drawings.

Figure 3:
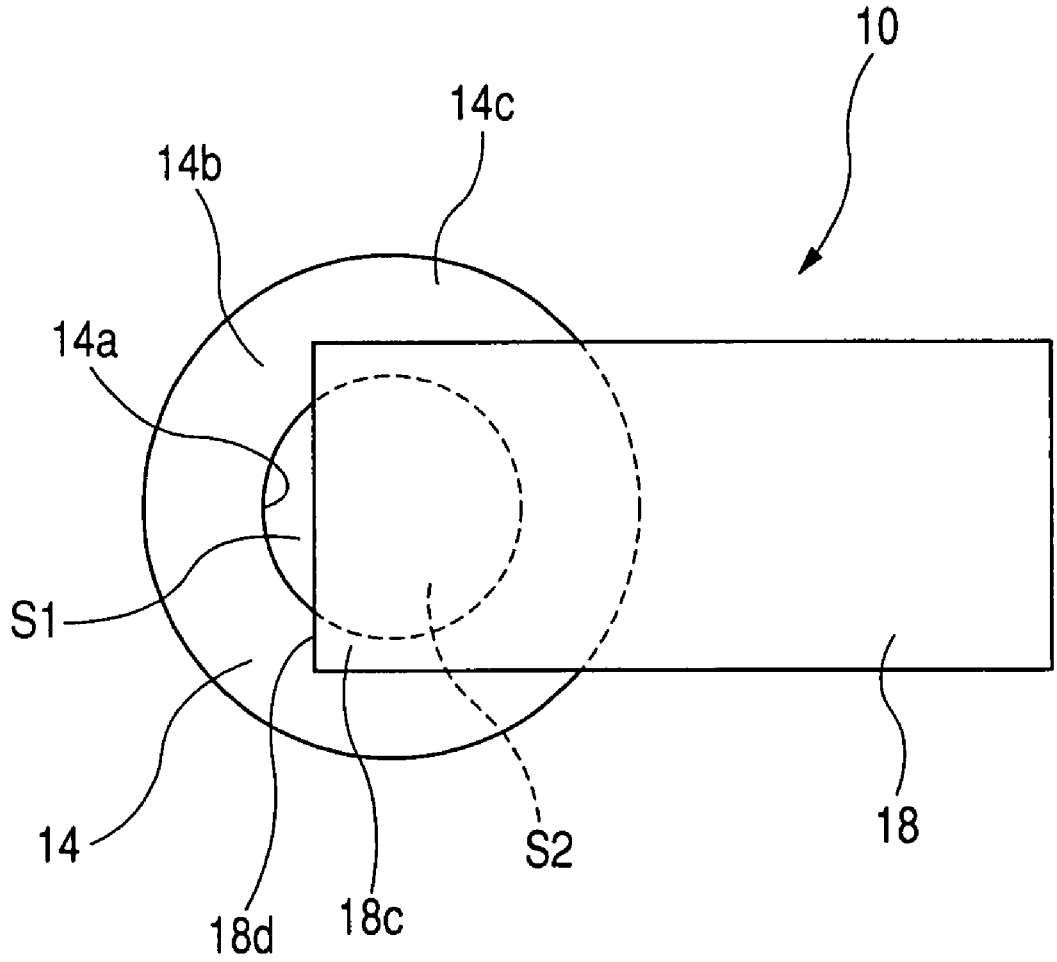
FIG. 3 is an enlarged view of the spark plug of the first embodiment, shown in FIG. 1, as viewed from a distal end of the spark plug.

As shown in FIGS. 1 and 3, the spark plug 10 of the present embodiment comprises a cylindrical metal shell 12, an porcelain insulator 14 fixedly held with the cylindrical metal shell 12 and having a through-bore 14*a* and a leading end portion 14*b* extending in a center axis thereof, a center electrode 16 fixedly supported in a through-bore 14*a* of the porcelain insulator 14 in a center axis thereof, and a ground electrode 18 fixedly bonded to a leading end 12*a* of the cylindrical metal shell 12 to provide a spark discharge gaps 20 with respect to the center electrode 16.

The cylindrical metal shell 12 includes an intermediate body 12*b*, an upper section 12*c* having an outer circumferential periphery formed in a hexagonal shape to serve as a tool-fitting section 12*d*, and a lower section 12*e* having an outer circumferential periphery formed with a mounting thread 12*f* to be screwed into an engine block (not shown).

The ground electrode 18 has a longitudinally extending base end 18*a* connected to the leading end 12*a* of the cylindrical metal shell 12, an intermediate section 18*b* extending downward from the base end 18*a*, and a laterally extending leading end portion 18*c* having one end contiguous with the intermediate section 18*b* and the other end placed in face-to-face relationship with a noble metal tip 22 of the center electrode 16 to provide a spark discharge gap 20.

As shown in FIG. 3, the through-bore 14*a* of the porcelain insulator 14 has a surface area S1 (cross-sectional area S1) exposed from an end face 18*d* of the ground electrode 18 in a position as viewed from a distal end of the spark plug 10. The through-bore 14*a* of the porcelain insulator 14 has a total surface area S2 (total cross-sectional area S2) with S1, S2 laying in the relationship expressed as S1/S2≦0.3.

Figure 2:
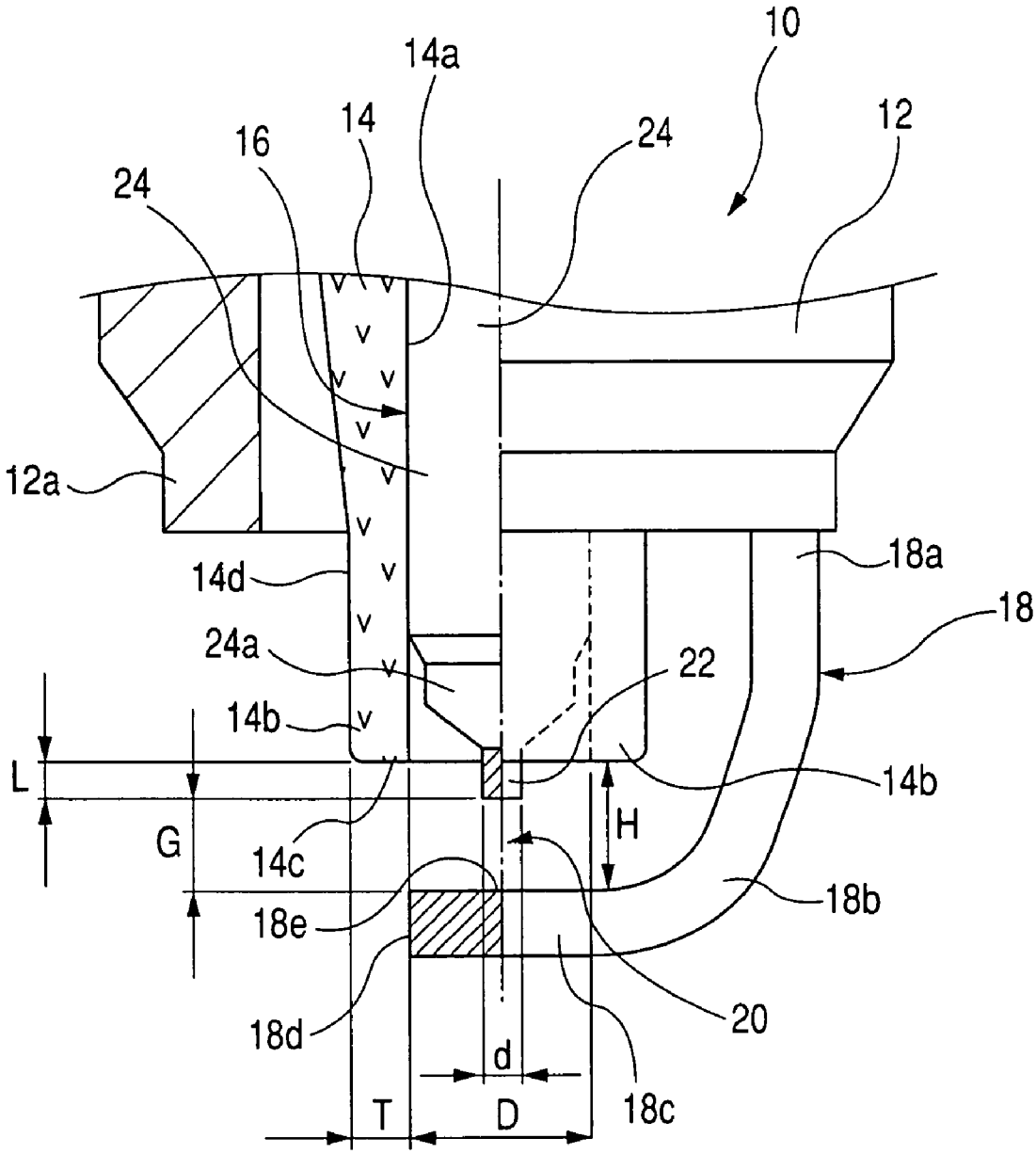
FIG. 2 is an enlarged fragmentary view of the spark plug of the first embodiment shown in FIG. 1.

Further, as shown in FIG. 2, the noble metal tip 22 of the center electrode 16 extends from a lower end face 14*c* of the leading end portion 14*b* by a protruding length L falling in the relationship expressed as L≦0.6 mm.

Further, the leading end portion 18*c* of the ground electrode 18 has a ground electrode planar surface section 18*e* that is spaced from the lower end face 14*c* of the leading end portion 14*b* of the porcelain insulator 14 by a distance H falling in a value between a minimal value Hmin and a maximal value Hmax defined in the relationship expressed as Hmax/Hmin≦1.3.

Furthermore, the leading end portion of the porcelain insulator 14 has an insulator wall thickness T, defined between the through-bore 14*a* of the porcelain insulator 14 and an outer circumferential periphery 14*d* thereof, which lies in the relationship T≦0.7 mm. Here, the term "wall thickness T" refers to a distance between an inner peripheral wall of the through-bore 14*a* of the porcelain insulator 14 and the outer circumferential periphery 14*d* thereof.

Moreover, the noble metal tip 22 of the center electrode 16 has a diameter d that falls in the relationship expressed as d≦0.6 mm.

In addition, the spark discharge gap 20 has a clearance G falling in the relationship expressed as G≦1.3 mm.

Besides, the through-bore 14*a* of the porcelain insulator 14 has an inner diameter D falling in the relationship expressed as D≦2.5 mm.

The center electrode 16 has a leading end portion provided with the noble metal tip 22 made of Ir alloy or Pt alloy or the like. That is, the center electrode 16 comprises a center electrode body 24, made of Ni-based alloy or the like and having a cone-shaped nose portion 24*a*, and the noble metal tip 22 bonded to the cone-shaped nose portion 24*a* of the center electrode body 24. In particular, the center electrode body 24 is inserted to and supported with the through-bore 14*a* and the cone-shaped nose portion 24*a* of center electrode 16 is placed axially inward with respect to the end face 14*c* of the porcelain insulator 14, that is, disposed in the through-bore 14*a* of the porcelain insulator 14 in an area inside the leading end portion 14*b* thereof. Under such a structure, the noble metal tip 22 has a leading end portion axially protruding from the end face 14*c* of the porcelain insulator 14.

Further, the ground electrode 18 has the base end portion 18*a* bonded to the leading end portion 12*a* of the metal shell 12 and the leading end portion 18*c* placed in face-to-face relationship with the leading end portion of the noble metal tip 22 to provide the spark discharge gap 20. The ground electrode 18 is made of Ni-based alloy or the like. With the present embodiment, the leading end portion 18*c* has no protrusion but has the ground electrode planar surface section 18*e* in an area facing the noble metal tip 22 of the center electrode 16.

Furthermore, the ground electrode planar surface section 18*e* is placed in parallel to the end face 14*c* of the leading end portion 14*b* of the porcelain insulator 14 within a tolerance satisfying the relationship expressed as Hmax/Hmin≦1.3. In addition, the ground electrode planar surface section 18*e* is spaced from the end face 14*c* of the leading end portion 14*b* of the porcelain insulator 14 by a distance H in a range from 0.7 to 2.1 mm.

Moreover, the spark plug 10 of the present embodiment may be employed as igniting means for an internal combustion engine of a motor vehicle or the like. In use, the spark plug 10 is mounted on a combustion chamber of the internal combustion engine by means of the threaded portion 12*f* of the metal shell 12.

With such a structure mentioned above, the spark plug 10 has various advantageous effects as listed below.

Figure 4:
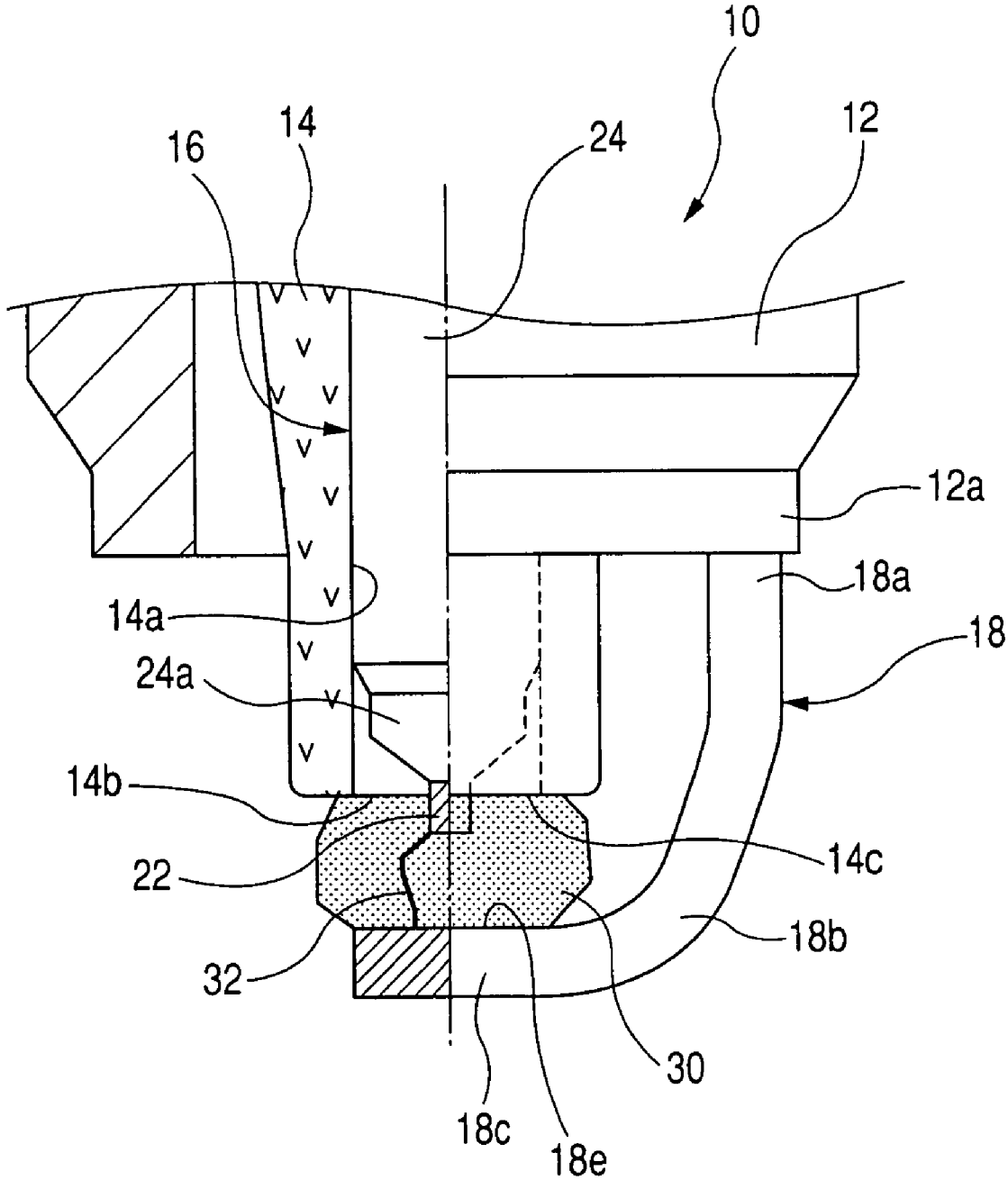
FIG. 4 is an illustrative view showing the spark plug of the first embodiment in the vicinity of a distal end thereof showing a fuel bridge being formed between a center electrode and a ground electrode.

The spark plug 10 comprises various component parts associated with each other under the positional relationships set forth above. Under such positional relationships, a fuel bridge 30 occurs in an area between the center electrode 16 and the ground electrode 18 during igniting operation in the combustion chamber of the internal combustion engine (not shown) as shown in FIG. 4. When this takes place, liquid fuel adheres onto an entire circumference of the insulator leading end portion 14*b* so as to cover the center electrode 16 and the through-bore 14*a*.

Figure 6:
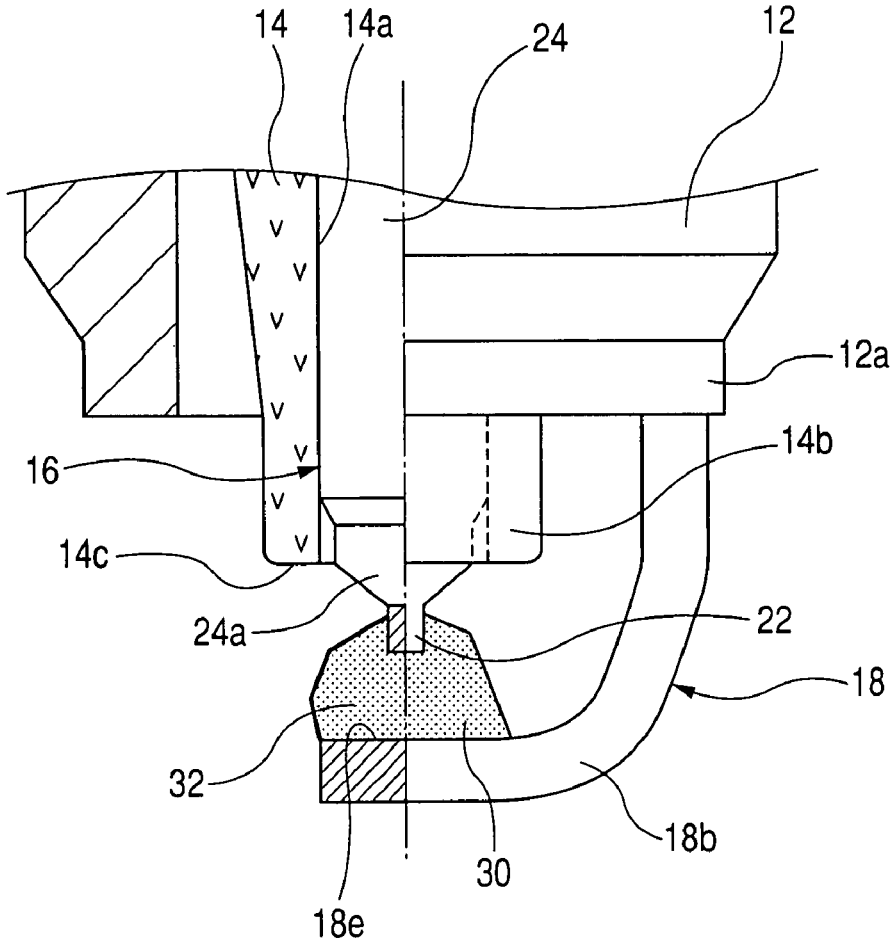
FIG. 6 (PRIOR ART)
FIG. 6 is an illustrative view showing a spark plug of the related art wherein a fuel bridge is formed in disproportionate pattern in an area between a center electrode and a ground electrode.

Under such a situation, if a high voltage is applied across the center electrode 16 and the ground electrode 18, a spark discharge takes place along a spark discharge path 32 penetrating through an inside of liquid fuel in the form of the fuel bridge 30. That is, if the fuel bridge 30 is not formed in a bridge pattern so as to completely cover the center electrode 16 and the through-bore 14*a* as shown in FIG. 6, the spark discharge path 32 takes the form of a path passing through an area filled with an air-fuel mixture with low insulating resistance or passing through another area in face of a surface of liquid fuel. However, as set forth above, with the spark plug 10 of the present embodiment, liquid fuel adheres onto the entire circumference of the insulator leading end portion 14*b* so as to cover the center electrode 16 and the through-bore 14*a* during a phase in which the fuel bridge 30 occurs (see FIG. 4). This allows the spark discharge path to be blocked from occurring in the area with low insulating resistance as set forth above, thereby ensuring the spark discharge path 32 to occur through the inside of liquid fuel.

Figure 5:
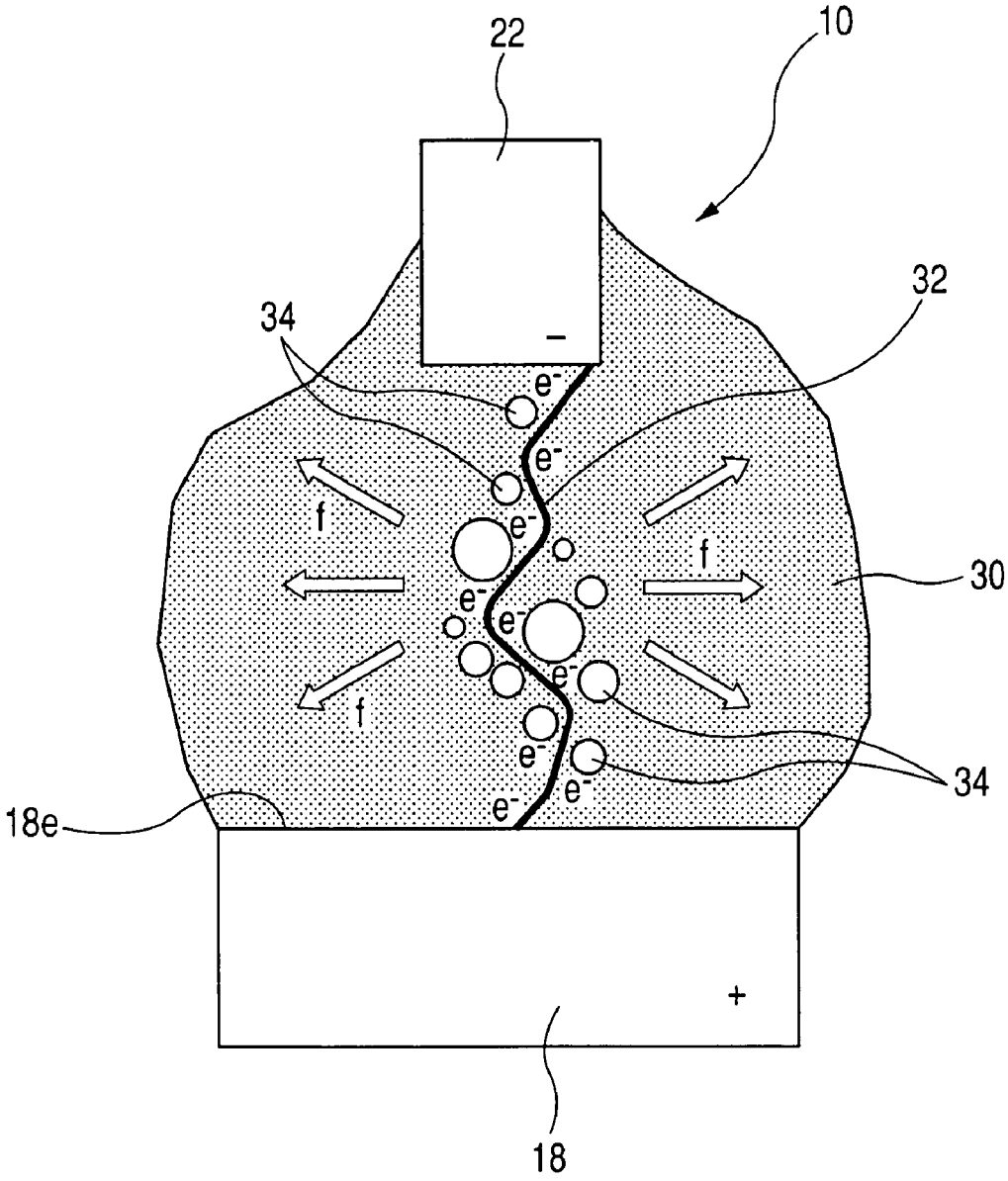
FIG. 5 is an illustrative view illustrating a principle how the fuel bridge is broken down due to a spark discharge in the spark plug of the first embodiment shown in FIG. 1.

Then, the fuel bridge 30 is broken down and removed due to energy of spark discharge passing through the inside of liquid fuel (in the form of the fuel bridge 30). More particularly, as shown in FIG. 5 in an enlarged scale, causing a spark discharge to occur through the spark discharge path 32 in the inside of liquid fuel forming the fuel bridge 30 enables discharge energy to instantaneously evaporate a partial area of liquid fuel in the inside thereof. When this takes place, discharge energy creates forces "f" directed from an inward area to an outward area to disintegrate the fuel bridge 30, thereby causing the fuel bridge 30 to be instantaneously removed.

That is, as shown in FIG. 5, a partial area of liquid fuel instantaneously is instantaneously exposed to high temperatures in surrounding areas of the spark discharge path 32 along which the spark discharges occurs and evaporated into a large amount of gas bubbles 34 distributed along the spark discharge path 32. With the formation of such instantaneously present gas bubbles 34, the forces "f" are created from the inside of the fuel bridge 30 to the outside thereof, enabling the fuel bridge 30 to be disintegrated.

The spark plug 10 of the present embodiment formed in such concrete positional relationships has advantageous effects as described below in detail with reference to particular component parts.

First, the through-bore 14*a* of the porcelain insulator 14 is exposed from the end face 18*d* of the leading end portion 18*c* of the ground electrode 18 in the surface area S1, as viewed from the distal end of the spark plug 10, and has the total surface area S2 falling in the relationship expressed as S1/S2≦0.3 (see FIG. 3). This enables the fuel bridge 30 to be easily formed in a pattern so as to cover the entire circumference of the insulator through-bore 14*a* in an air space between the end face 14*c* of the leading end portion 14*b* of the porcelain insulator 14 and the ground electrode planar surface section 18*e* of the leading end portion 18*c* of the ground electrode 18.

Further, with the noble metal tip 22 protruding from the end face 14*c* of the leading end portion 14*b* of the porcelain insulator 14 with the protruding length L under the relationship expressed as L≦0.6 mm, the fuel bridge 30 becomes liable to easily adhere not only onto an area between the end face 14*c* of the leading end portion 14*b* of the porcelain insulator 14 and the ground electrode planar surface section 18*e* of the leading end portion 18*c* of the ground electrode 18 but also onto the leading end portion 14*b* of the porcelain insulator 14. Thus, the noble metal tip 22, arranged to protrude from the end face 14*c* of the leading end portion 14*b* of the porcelain insulator 14 with a given protruding length L, enables the fuel bridge 30 to be formed in an appropriate pattern to cover the entire circumference of the insulator through-bore 14*a*.

If, in contrast, the noble metal tip 22 of the center electrode 16 protrudes from the end face 14*c* of the leading end portion 14*b* of the porcelain insulator 14 in an increased protruding length L under the relationship L>0.6 mm, the fuel bridge 30 becomes liable to adhere only onto the area between the center electrode 16 and the ground electrode 18 as shown in FIG. 6. Thus, there is a fear of the fuel bridge 30 encountering a difficulty to be formed in an appropriate fuel distributing pattern so as to cover the entire circumference of the insulator through-bore 14*a*.

Further, the spark plug 10 is structured such that the ground electrode planar surface section 18*e* is spaced from the lower end face 14*c* of the leading end portion 14*b* of the porcelain insulator 14 by the distance H under the relationship expressed as Hmax/Hmin≦1.3. Such a positional relationship prevents the fuel bridge 30 from being formed in a disproportionate pattern, enabling the fuel bridge 30 to be easily formed in an appropriate pattern so as to cover the entire circumference of the insulator through-bore 14*a* as shown in FIG. 4.

Figure 7:
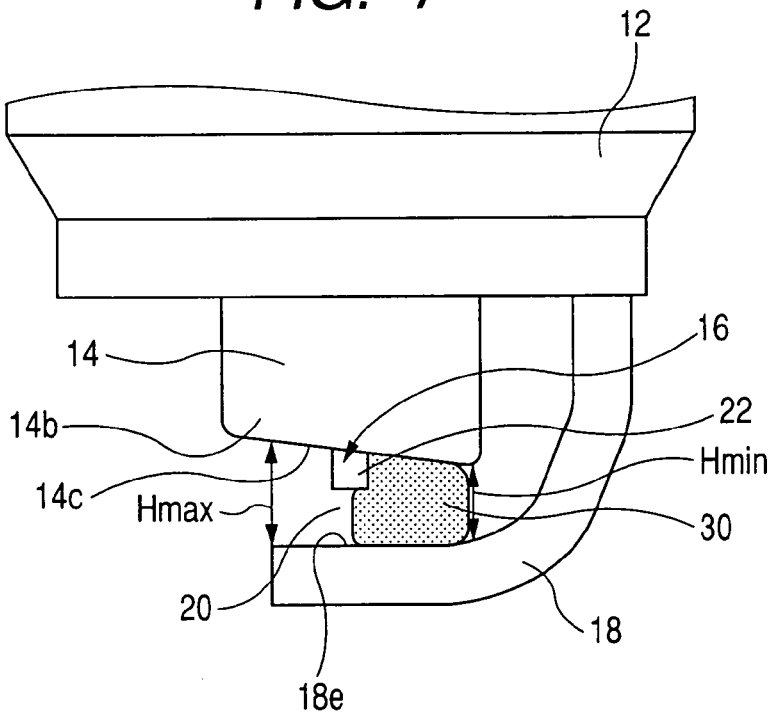
FIG. 7 is an illustrative view showing how a fuel bridge is formed in a disproportionate pattern with a structure taking an increased value in Hmax/Hmin.

By way of experiment, if the distance H takes an increased value between the minimal value Hmin and the maximal value Hmax to fall in the relationship expressed as Hmax/Hmin>1.3 with an increase in unevenness in the distance H as shown in FIG. 7, the fuel bridge 30 tends to be formed in a segmented area under a disproportionate pattern, that is, in an area dislocated from a central axis of the noble metal tip 22 of the center electrode 16. This results in an increased probability for the fuel bridge 30 to be formed in the disproportionate pattern with the resultant difficulty of covering the entire circumference of the insulator through-bore 14*a* as shown in FIG. 4.

Further, the wall thickness T of the leading end portion 14*b* of the porcelain insulator 14 laying in the relationship expressed as T≦0.7 mm enables the prevention of the fuel bridge 30 from having an increased contact surface area for the leading end portion 14*b* of the porcelain insulator 14. This enables the prevention of the fuel bridge 30 from being formed in the disproportionate pattern. Accordingly, the fuel bridge 30 can be formed in an appropriate pattern so as to cover the entire circumference of the insulator through-bore 14*a* as shown in FIG. 4.

Figure 8:
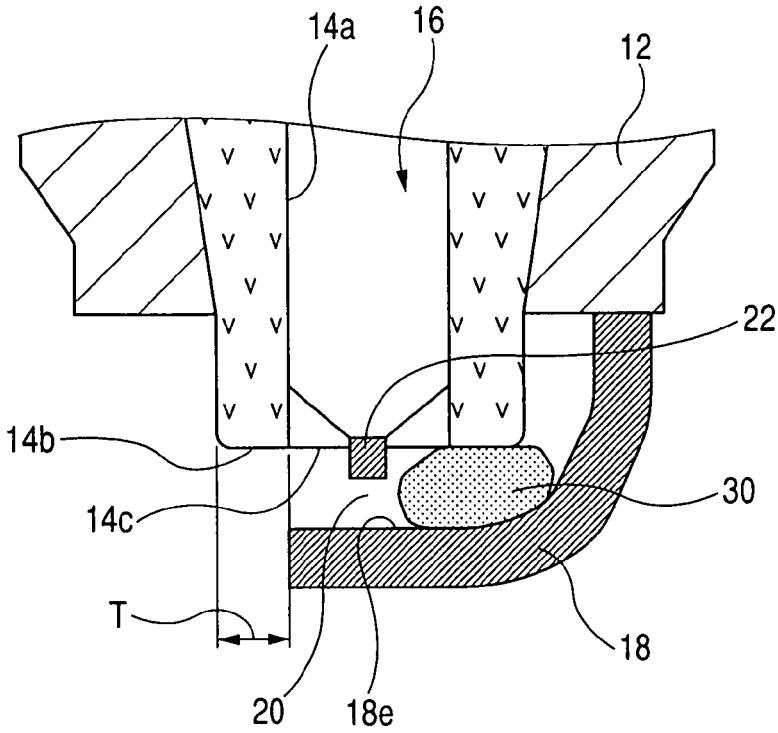
FIG. 8 is an illustrative view showing how a fuel bridge is formed in a disproportionate pattern with a structure taking an increased value in an insulator wall thickness T.
Figure 9:
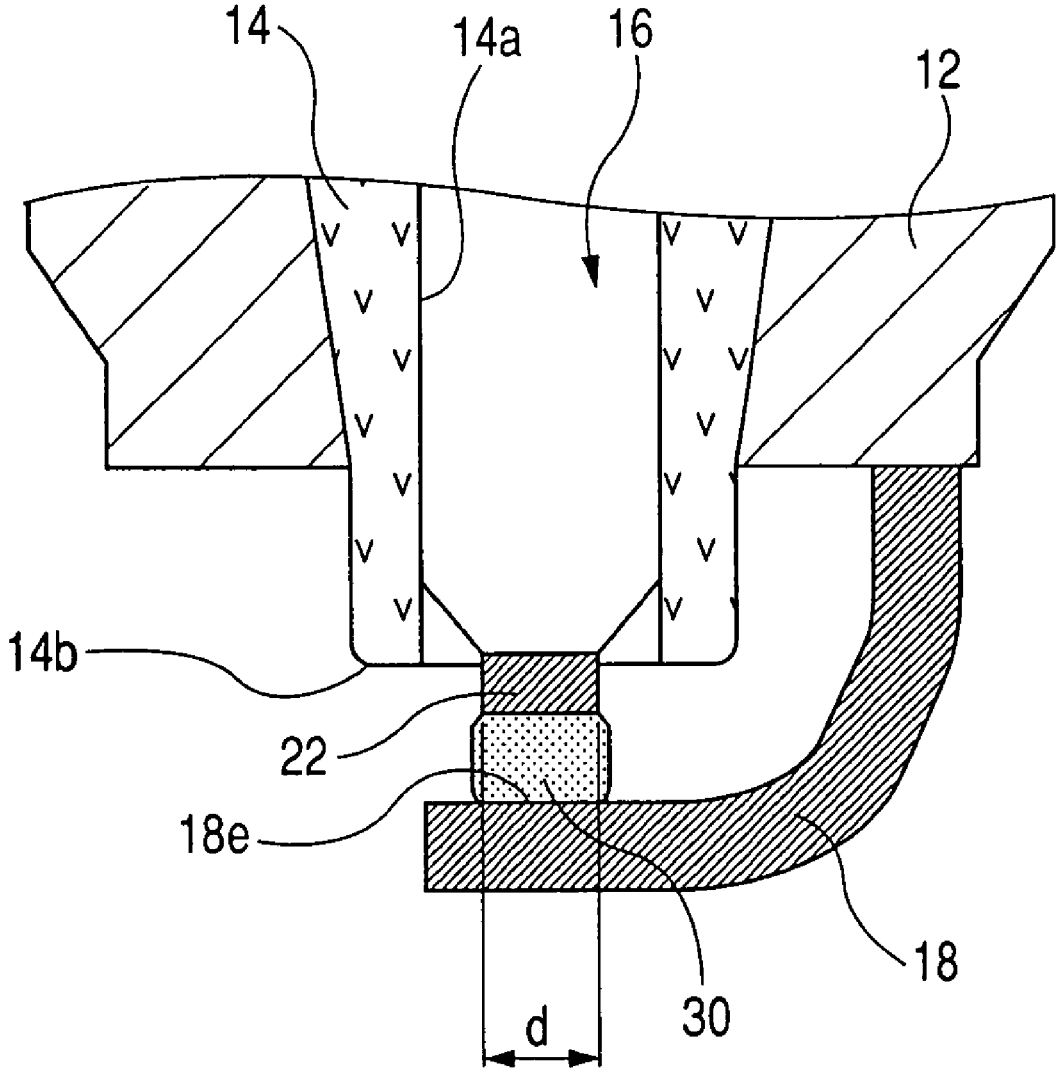
FIG. 9 is an illustrative view showing a fuel bridge liable to be formed in a disproportionate pattern with a structure in which a center electrode has a leading end portion with an increased diameter "d".

By way of experiment, if the wall thickness T of the leading end portion 14*b* of the porcelain insulator 14 takes an increased value under the relationship expressed as T>0.7 mm, the fuel bridge 30 has a contact surface that is too large for the end face 14*c* of the insulator leading end 14*b* as shown in FIG. 8, causing an increased tendency to occur the for fuel bridge 30 to be formed under disproportionate pattern. Thus, there is a fear of the fuel bridge 30 encountering a difficulty of covering the entire circumference of the insulator through-bore 14*a*.

Furthermore, the leading end, that is, the noble metal tip 22, of the center electrode 16 has the diameter "d" under the relationship expressed as d≦0.6 mm, the fuel bridge 30 is liable to adhere onto not only an area between the center electrode 16 and the ground electrode 18 but also the end face 14*c* of the leading end portion 14*b* of the porcelain insulator 14. This enables the fuel bridge 30 to be formed in an appropriate pattern so as to cover the entire circumference of the insulator through-bore 14*a*.

By way of experiment, if the diameter "d" of the noble metal tip 22 of the center electrode 16 increases under the relationship d>0.6 mm, the fuel bridge 30 tends to be formed in onto only the area between the center electrode 16 and the ground electrode 18 with the resultant occurrence of a fear of the fuel bridge 30 encountering a difficulty of covering the entire circumference of the insulator through-bore 14*a*.

Thus, with the spark plug 10 composed of the component parts arranged under the dimensional relationships set forth above, the spark plug 10 allows the fuel bridge 30 to be easily formed in an appropriate pattern so as to cover the entire circumference of the insulator through-bore 14*a*. This allows a spark discharge to easily occur in the inside of the fuel bridge 30, thereby enabling spark discharge energy to instantaneously remove the fuel bridge 30.

Therefore, it becomes possible to obtain a spark plug 10 for an internal combustion engine with increased fuel-bridging resistance.

Moreover, with the spark discharge gap 20 formed in the clearance G under the relationship expressed as G≦1.3 mm, the fuel bridge 30 is formed in a stable position, providing an ease of forming the fuel bridge 30 in an appropriate pattern so as to cover the entire circumference of the insulator through-bore 14*a*.

In addition, the through-bore 14*a* of the porcelain insulator 14, arranged to have the inner diameter D under the relationship expressed as D≦2.5 mm, minimizes an amount of fuel needed for the entire circumference of the insulator through-bore 14*a* to be covered in the fuel bridge 30, providing a further ease of forming the fuel bridge 30 in the appropriate pattern so as to cover the entire circumference of the insulator through-bore 14*a*.

With the present invention, as set forth above, it becomes possible to provide a spark plug for an internal combustion engine with increased fuel-bridging resistance.

Second Embodiment

A spark plug 10A of a second embodiment according to the present invention for an internal combustion engine is described with reference to FIG. 10.

Figure 10:
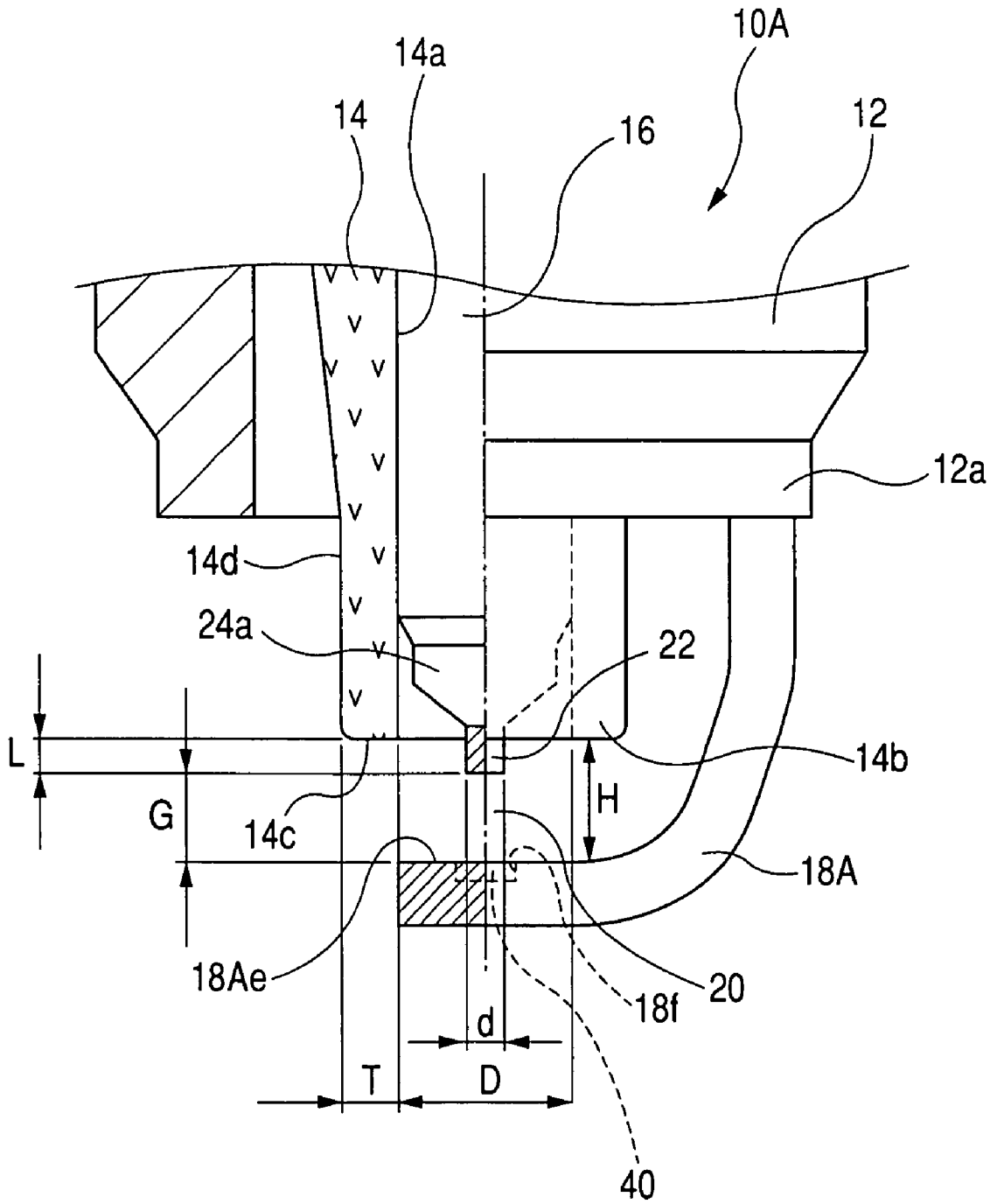
FIG. 10 is a half cross-sectional view showing a leading end portion of a spark plug of a second embodiment according to the present invention.

As shown in FIG. 10, with the spark plug 10A of the present embodiment, a planar surface section 18Ae of a ground electrode 18A has a concaved portion 18*f* in which a noble metal tip 40 is buried in face-to-face relationship with the noble metal tip 22 of the center electrode 16.

The noble metal tip 40 may be made of, for instance, an Ir alloy or Pt alloy or the like.

Further, the noble metal tip 40 has a top surface placed in coplanar relationship with a base material section of the ground electrode 18A. That is, the ground electrode 18A has a ground electrode planar surface section 18Ae on the same plane with the noble metal tip 40.

The spark plug 10A of the present embodiment has the other same structure as the structure of the spark plug 10 of the first embodiment set forth above.

With the spark plug 10A of the present embodiment, the ground electrode 18A can have increased wear-resistance and fire-jumping ability.

In addition, the spark plug 10A of the present embodiment has the other same advantageous features as those of the spark plug 10 of the first embodiment set forth above.

Third Embodiment

A spark plug 10B of a third embodiment according to the present invention for an internal combustion engine is described with reference to FIG. 11.

Figure 11:
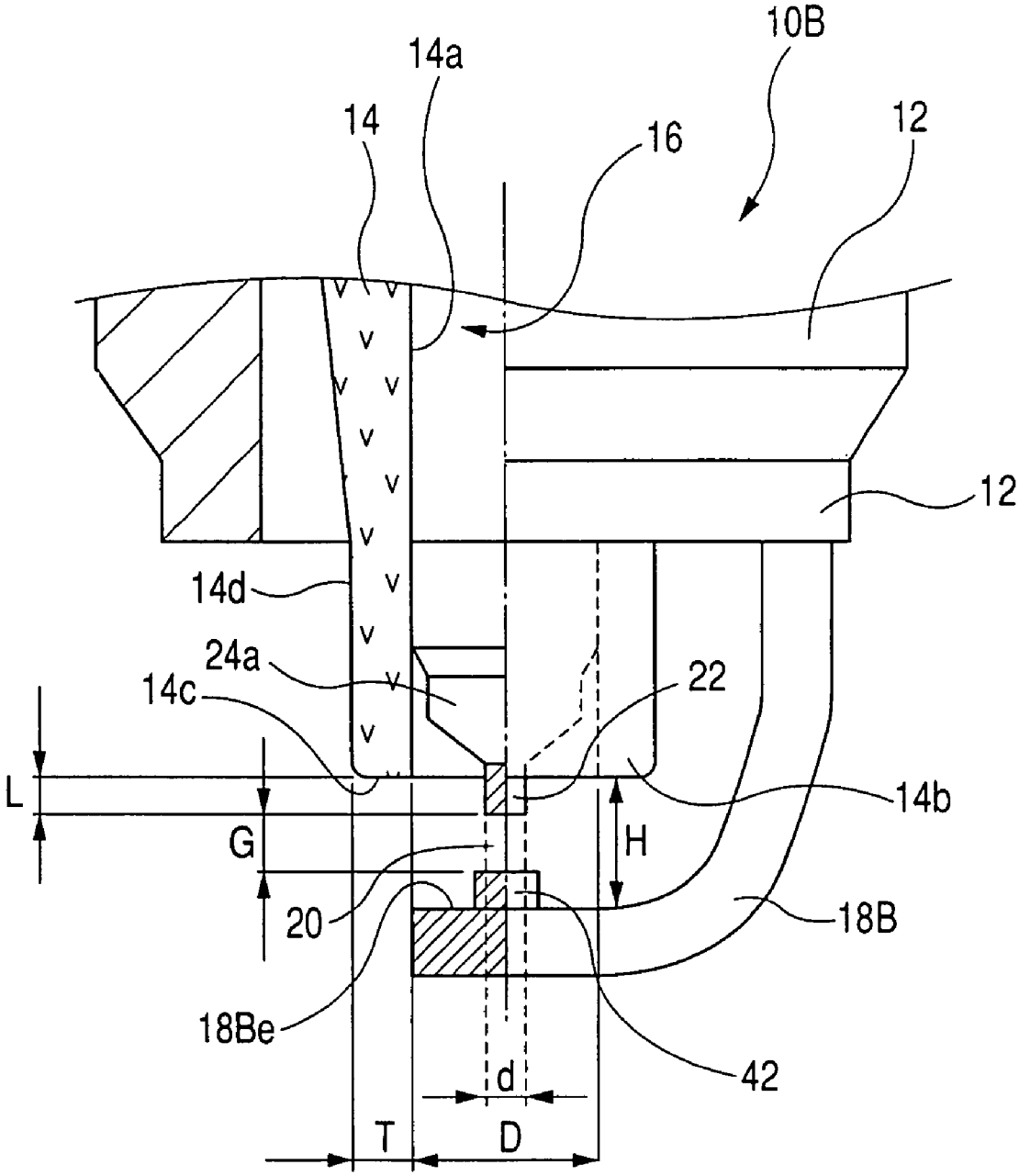
FIG. 11 is a half cross-sectional view showing a leading end portion of a spark plug of a third embodiment according to the present invention.

As shown in FIG. 11, with the spark plug 10B of the present embodiment, a noble metal tip 42 is bonded to a planar surface section 18Be of a ground electrode 18B in face-to-face relationship with the noble metal tip 22 of the center electrode 16.

The noble metal tip 42 may be made of, for instance, Ir alloy or Pt alloy or the like.

With the spark plug 10B of the present embodiment, the ground electrode 18B has the ground electrode planar surface section 18Be in an area except for the noble metal tip 42. In addition, the distance H (covering Hmax and Hmin) between the end face 14*c* of the leading end portion 14*b* of the porcelain insulator 14 and the ground electrode planar surface section 18Be is a distance measured between the end face 14*c* of the leading end portion 14*b* of the porcelain insulator 14 and the ground electrode planar surface section 18Be in an area except for the noble metal tip 42.

With the spark plug 10B of the present embodiment, a distance between a distal end of the center electrode 16 (on the noble metal tip 22) and the ground electrode (on the noble metal tip 42) represents a dimension G of the spark discharge gap 20 under the relationship G≦1.3 mm.

In addition, the noble metal tip 42 of the ground electrode 18B protrudes from the planar surface section 18Be in a protruding length of 0.7 mm.

The spark plug 10B of the present embodiment has the other same structure as the structure of the spark plug 10 of the first embodiment set forth above.

With the spark plug 10B of the present embodiment, the ground electrode 18B can have increased wear-resistance and fire-jumping ability.

In addition, the spark plug 10B of the present embodiment has the other same advantageous features as those of the spark plug 10 of the first embodiment set forth above.

(First Evaluation Test)

Various samples of spark plugs were prepared as test pieces with associated component parts taking various dimensions under different positional relationships to evaluate the degrees of fuel bridge removability.

In evaluating fuel bridge removability of the various test pieces, a simplified test method was adopted replacing fuel with silicone oil with a viscosity adjusted to be equal to that of fuel at a temperature of −30° C. Then, such silicone oil was applied to the test pieces so as to allow silicone oil to be bridged in each spark discharge gap. Subsequently, each sample was left in a pressure vessel and a high voltage was applied to a center electrode and a ground electrode of each sample, upon which evaluations on fuel bridge removability of each sample were conducted checking whether or not a fuel bridge was removed from between the center electrode and the ground electrode of each sample.

In achieving a spark discharge, a full transformer coil was used as an ignition coil and the pressure vessel was maintained under 0.5 MPa. Then, the evaluation tests were repeatedly conducted ten times for each sample, thereby calculating bridge-removing probabilities. One test piece with a bridge-removing probability greater than 70% was treated to be "OK" and the other test piece with a bridge-removing probability less than 70% was treated to be "NG".

Table 1 shows the dimensional relationships of each test piece and test results of the test pieces.

Also, in Table 1, "S1", "S2", "L", "Hmax", "Hmin", "T" and "d" indicates various dimensions designated in the spark plug 1 of the first embodiment shown in FIG. 1. In addition, the test piece 19 represents a commonly used spark plug of the related art.

TABLE 1

| Sample | S1/S2 | L | Hmax/Hmin | T | d | Bridge Removability | Evaluation |
|---|---|---|---|---|---|---|---|
| 1 | 0 | 0.4 | 1.2 | 0.6 | 0.5 | 100% | OK |
| 2 | 0.2 | 0.4 | 1.2 | 0.6 | 0.5 | 100% | OK |
| 3 | 0.3 | 0.4 | 1.2 | 0.6 | 0.5 | 100% | OK |
| 4 | 0.4 | 0.4 | 1.2 | 0.6 | 0.5 | 60% | NG |
| 5 | 0 | 0.5 | 1.2 | 0.6 | 0.5 | 100% | OK |
| 6 | 0 | 0.6 | 1.2 | 0.6 | 0.5 | 80% | OK |
| 7 | 0 | 0.7 | 1.2 | 0.6 | 0.5 | 30% | NG |
| 8 | 0 | 0.4 | 1.1 | 0.6 | 0.5 | 100% | OK |
| 9 | 0 | 0.4 | 1.2 | 0.6 | 0.5 | 100% | OK |
| 10 | 0 | 0.4 | 1.3 | 0.6 | 0.5 | 90% | OK |
| 11 | 0 | 0.4 | 1.4 | 0.6 | 0.5 | 50% | NG |
| 12 | 0 | 0.4 | 1.2 | 0.5 | 0.5 | 100% | OK |
| 13 | 0 | 0.4 | 1.2 | 0.7 | 0.5 | 80% | OK |
| 14 | 0 | 0.4 | 1.2 | 0.9 | 0.5 | 60% | NG |
| 15 | 0 | 0.4 | 1.2 | 0.6 | 0.4 | 100% | OK |
| 16 | 0 | 0.4 | 1.2 | 0.6 | 0.5 | 100% | OK |
| 17 | 0 | 0.4 | 1.2 | 0.6 | 0.6 | 90% | OK |
| 18 | 0 | 0.4 | 1.2 | 0.6 | 0.7 | 60% | NG |
| 19 | 0 | 1.5 | 1.2 | 1.1 | 0.6 | 0% | NG |

As will be understood from Table 1, one sample 19 (a product of the related art) with the related art structure was failed in removing a fuel bridge. With other samples composed of the component parts formed in dimensional relationships falling in a range specified below, the other samples achieved the bridge-removing probability higher than 70% to be good products with the evaluations regarded to be "OK".

That is, for the positional relationship related to the surface area ratio (S1/S2), the samples (test pieces Nos. 1 to 3) were evaluated to be good products when S1/S2≦0.3. For the ratio (Hmax/Hmin) between the minimal value and the maximal value in distance between the insulator end face and the ground electrode planar surface section, the samples (test pieces Nos. 8 to 10) were evaluated to be good products when Hmax/Hmin≦1.3. For the insulator wall thickness T, the samples (test pieces Nos. 12 and 13) were evaluated to be good products when T≦0.7 mm. For the diameter "d" of the noble metal tip 22, the samples (test pieces Nos. 15 to 17) were evaluated to be good products when d≦0.6 mm.

For these results, it is concluded that the spark plugs implementing the present invention have conditions to increase the fuel bridge removability with increased fuel-bridging resistance.

(Second Evaluation Test)

TABLE 2

| Sample | S1/S2 | L | Hmax/Hmin | T | d | Bridge Removability | Startup Time |
|---|---|---|---|---|---|---|---|
| 1 | 0 | 0.4 | 1.2 | 0.6 | 0.5 | 100% | 4.1 sec |
| 6 | 0 | 0.6 | 1.2 | 0.6 | 0.5 | 80% | 4.5 sec |
| 7 | 0 | 0.7 | 1.2 | 0.6 | 0.5 | 30% | 6.5 sec |
| 11 | 0 | 0.4 | 1.4 | 0.6 | 0.5 | 50% | 4.8 sec |
| 14 | 0 | 0.4 | 1.2 | 0.9 | 0.5 | 60% | 5.6 sec |
| 15 | 0 | 0.4 | 1.2 | 0.6 | 0.4 | 100% | 4.0 sec |
| 18 | 0 | 0.4 | 1.2 | 0.6 | 0.7 | 60% | 5.8 sec |
| 19 | 0 | 1.5 | 1.2 | 1.1 | 0.6 | 0% | 10.2 sec |

As will be apparent from Table 2, it is clearly turned out from the first Evaluation Test that as the bridge removability increases, a startup time decreases. From such a tendency, it is concluded that there is a strong correlation between the simplified test, conducted in the first Evaluation Test, and startability at ultracold temperature.

Accordingly, it is turned out that the spark plug for the internal combustion engine implementing the present invention has excellent startability at ultracold temperature.

While the specific embodiment of the present invention has been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. A spark plug for an internal combustion engine, comprising:

a metal shell having an outer periphery formed with a mounting thread;

a porcelain insulator fixedly secured to the metal shell on a central axis thereof and having a through-bore;

a center electrode, having a leading end portion, which extends through the through-bore of the porcelain insulator and retained therewith in a fixed place along the central axis of the porcelain insulator; and a ground electrode extending from the metal shell and having a leading end placed in face-to-face relationship with the leading end portion of the center electrode to provide a spark discharge gap;

wherein the through-bore of the porcelain insulator is exposed from an end face of the leading end portion of the ground electrode in a cross-sectional area S1, as viewed in a center axis direction of the center electrode and the porcelain insulator from a distal end of the spark plug, and has a total cross-sectional area S2 falling in the relationship expressed as S1/S2≦0.3;

wherein the center electrode protrudes from an end face of the porcelain insulator with a protruding length L under the relationship expressed as L≦0.6 mm;

wherein a minimal value Hmin and a maximal value Hmax in distance between a planar surface section of the ground electrode and the end face of the porcelain insulator lay in the relationship expressed as Hmax/Hmin≦1.3;

wherein a wall thickness T between the through-bore and an outer periphery of the porcelain insulator lies in the relationship expressed as T≦0.7 mm; and wherein the leading end of the center electrode has a diameter d under the relationship expressed as d≦0.6 mm.

2. The spark plug for the internal combustion engine according to claim 1, wherein:

the spark discharge gap has a size G falling in the relationship expressed as G≦1.3 mm.

3. The spark plug for the internal combustion engine according to claim 1, wherein:

the through-bore of the porcelain insulator has an inner diameter D under the relationship expressed as D≦2.5 mm.

4. The spark plug for the internal combustion engine according to claim 1, wherein:

the leading end portion of the center electrode comprises a noble metal chip.

5. The spark plug for the internal combustion engine according to claim 4, wherein:

the planar surface section of the ground electrode comprises a noble metal chip placed in face-to-face relationship with the noble metal chip of the center electrode to provide the spark discharge gap.

6. The spark plug for the internal combustion engine according to claim 5, wherein:

the noble metal chip of the ground electrode is placed on the planar surface section in a coplanar relationship therewith and in face-to-face relationship with the noble metal chip of the center electrode to provide the spark discharge gap.

7. The spark plug for the internal combustion engine according to claim 4, wherein:

the noble metal chip of the ground electrode protrudes from the planar surface section in face-to-face relationship with the noble metal chip of the center electrode to provide the spark discharge gap.

* * * * *